US011353219B2

(12) United States Patent
Iwamoto et al.

(10) Patent No.: US 11,353,219 B2
(45) Date of Patent: Jun. 7, 2022

(54) HEATING COOKER

(71) Applicant: Samsung Electronics Co., Ltd., Suwon-si (KR)

(72) Inventors: Kiyoshi Iwamoto, Yokohama (JP); Kazuo Shimizu, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 229 days.

(21) Appl. No.: 16/946,727

(22) Filed: Jul. 2, 2020

(65) Prior Publication Data

US 2021/0003289 A1 Jan. 7, 2021

(30) Foreign Application Priority Data

Jul. 2, 2019 (JP) ..... JP2019-123946
May 29, 2020 (KR) ..... 10-2020-0065355

(51) Int. Cl.
*F24C 15/32* (2006.01)
*F24C 15/00* (2006.01)
*F24C 7/08* (2006.01)

(52) U.S. Cl.
CPC ..... *F24C 15/322* (2013.01); *F24C 7/087* (2013.01); *F24C 15/006* (2013.01)

(58) Field of Classification Search
CPC .. F24C 7/02; F24C 7/08; F24C 15/006; F24C 15/02; F24C 15/322; H05B 6/6447; H05B 6/6455
See application file for complete search history.

(56) References Cited

U.S. PATENT DOCUMENTS 4,286,134 A * 8/1981 Nakata ..... H05B 6/745 219/757
4,347,418 A * 8/1982 Nobue ..... H05B 6/6411 250/351

(Continued)

FOREIGN PATENT DOCUMENTS

JP 2001227748 A * 8/2001 ..... H05B 6/6402
JP 4631042 B2 2/2011

(Continued)

OTHER PUBLICATIONS

International Search Report dated Oct. 15, 2020 in connection with International Patent Application No. PCT/KR2020/008587, 3 pages.

*Primary Examiner* — Jorge A Pereiro
*Assistant Examiner* — Nikhil P Mashruwala

(57) ABSTRACT

A heating cooker including a case including a cooking chamber configured to receive an object to be heated, a door configured to open and close the cooking chamber of the case, a ventilation path provided to extend along a wall surface of the cooking chamber in a state of being partitioned from the cooking chamber, a detector installed in the inside of the ventilation path and including one or more sensors configured to detect information on the inside of the cooking chamber through one or more detection holes formed on the wall surface of the cooking chamber, a shutter installed in the inside of the ventilation path and configured to open and close the one or more detection holes, and a cooling fan configured to suck outside air and blow the outside air into the ventilation path so as to cool the detector and the shutter together.

18 Claims, 14 Drawing Sheets

(56) References Cited

U.S. PATENT DOCUMENTS

| | | | | |
|---|---|---|---|---|
| 4,751,356 | A * | 6/1988 | Fukuda | H05B 6/6455 219/710 |
| 6,992,268 | B2 * | 1/2006 | Kim | F24C 15/34 219/401 |
| 7,967,002 | B2 * | 6/2011 | Inada | F24C 15/327 219/401 |
| 9,182,296 | B2 | 11/2015 | Bach et al. | |
| 9,903,597 | B2 * | 2/2018 | Nishijima | F01K 23/00 |
| 10,101,038 | B2 * | 10/2018 | Kim | F24C 3/087 |
| 2007/0158340 | A1 | 7/2007 | Kim et al. | |
| 2017/0292713 | A1 | 10/2017 | Boedicker et al. | |
| 2018/0216831 | A1 | 8/2018 | Armstrong | |

FOREIGN PATENT DOCUMENTS

| | | | | |
|---|---|---|---|---|
| JP | 2017-194217 | A | 10/2017 | |
| KR | 10-0214875 | B1 | 8/1999 | |
| KR | 10-2000-0051360 | A | 8/2000 | |
| WO | WO2007077160 | A2 * | 7/2007 | F24C 15/20 |

* cited by examiner

HEATING COOKER

CROSS-REFERENCE TO RELATED APPLICATIONS

This application is based on and claims priority under 35 U.S.C. 119 to Korean Patent Application No. 10-2020-0065355, filed on May 29, 2020, in the Korean Intellectual Property Office, which claims the benefit of Japanese Patent Application No. 2019-123946 filed on Jul. 2, 2019, in the Japan Patent Office, the disclosures of which are herein incorporated by reference in their entireties.

BACKGROUND

1. Field

The disclosure relates to a heating cooker including a sensor configured to detect information on the inside of a cooking chamber.

2. Description of Related Art

A heating cooker may include a sensor configured to detect information such as a position, a state, and a temperature of an object to be heated that is placed in a cooking chamber. The heating cooker is provided in such a way that a detection surface of the sensor faces the inside of the cooking chamber through an opening, which is formed on a wall of the cooking chamber, upon detecting information on the inside of the cooking chamber.

However, as for the heating cooker, the sensor has a risk of damage because the sensor is exposed to hot air convection in the inside of the cooking chamber. In addition, when the opening, which exposes the sensor, is open, the detection performance of the sensor may be deteriorated because the detection surface of the sensor is easily contaminated by steam or food residue of the inside of the cooking chamber. Therefore, it is required to take measures to protect the sensor from heat and contaminants.

Japanese unexamined patent application publication No. 2017-194217 discloses a heating cooker configured to protect a sensor from heat in a cooking chamber and prevent contamination of the sensor.

The disclosed heating cooker includes a sensor installed in such a way that a detection surface faces the inside of the cooking chamber through an opening on a wall surface of the cooking chamber, a ventilation path installed along the wall surface of the cooking chamber in which the sensor is located, and a cooling fan configured to suck outside air and blow the air into the ventilation path. The air blown into the ventilation path by the cooling fan may cool the sensor while passing through the detection surface of the sensor, and the air may flow to the inside of the cooking chamber through the opening so as to prevent steam or food residue of the inside of the cooking chamber from moving to the sensor.

The heating cooker includes a movable cylinder portion formed in a semi-cylindrical shape and configured to support the sensor, and a motor configured to rotate the movable cylinder portion. As the movable cylinder portion is rotated by an operation of the motor, the sensor may be rotated to allow the detection surface to face the opening or to face a direction opposite to the opening. The opening may be closed by the movable cylinder portion in a state in which the detection surface of the sensor is rotated to face the opposite side of the opening. Therefore, the heating cooker may prevent the detection surface of the sensor, which is not in use, from being contaminated by the steam or food residue of the inside of the cooking chamber.

However, as for the heating cooker, the movable cylinder portion that covers the opening is exposed to the heat of the cooking chamber in a state in which the detection surface of the sensor is rotated to face the opposite side of the opening. Therefore, the sensor may be deteriorated or damaged by the heat transferred to the sensor side through the movable cylinder portion.

RELATED ART DOCUMENT

Patent Document (Patent Document 1) Japanese Unexamined Patent Application Publication No. 2017-194217 (Oct. 26, 2017)

SUMMARY

Therefore, it is an aspect of the disclosure to provide a heating cooker capable of preventing a sensor configured to detect information on a cooking chamber from being deteriorated or damaged caused by a temperature rise.

Additional aspects of the disclosure will be set forth in part in the description which follows and, in part, will be obvious from the description, or may be learned by practice of the disclosure.

In accordance with an aspect of the disclosure, a heating cooker includes a case including a cooking chamber configured to receive an object to be heated, a door configured to open and close the cooking chamber of the case, a ventilation path provided to extend along a wall surface of the cooking chamber in a state of being partitioned from the cooking chamber, a detector installed in the inside of the ventilation path and including one or more sensors configured to detect information on the inside of the cooking chamber through one or more detection holes formed on the wall surface of the cooking chamber, a shutter installed in the inside of the ventilation path and configured to open and close the one or more detection holes, and a cooling fan configured to suck outside air and blow the outside air into the ventilation path so as to cool the detector and the shutter together.

The one or more sensors may be spaced apart from an inner surface of the ventilation path, and the shutter may be provided in such a way that a part which opens and closes the detection hole is spaced apart from the detector.

The heating cooker may further include an air guide member provided in the ventilation path and configured to guide air blown by the cooling fan to the detector and the shutter.

The detector may include a sensor unit rotatably installed to be spaced apart from the inner surface of the ventilation path, and to which the sensor is coupled, and a driver configured to rotate the sensor unit so as to displace the sensor unit to a first position, in which a detection surface of the sensor faces the detection hole, and to a second position, in which the detection surface of the sensor faces a direction different from the detection hole.

The shutter may be mounted on the sensor unit to be rotated together with the sensor unit, and when the detection surface of the sensor faces the first position, the shutter may open the detection hole and when the detection surface of the sensor faces the second position, the shutter may close the detection hole.

The shutter may include a fixer fixed to the sensor unit through an insulating member, and an opening and closing portion provided to extend from the fixer and configured to open and close the detection hole.

The opening and closing portion of the shutter may be spaced apart from an outer surface of the sensor unit so as to allow cooling air to flow between the outer surface of the sensor unit and an inner surface of the sensor unit.

The wall surface of the cooking chamber, on which the detection hole is located, may include a sensor receiving portion formed to have a cross section in a circular arc shape and provided to protrude toward the inside of the cooking chamber, and the opening and closing portion of the shutter may be bent in a shape corresponding to an inner surface of the sensor receiving portion.

The sensor unit may include a sensor housing formed of a material having a lower heat transfer property than the shutter.

The detection hole may include a first detection hole and a second detection hole that are spaced apart from each other, and the sensor may include a first sensor provided at a position corresponding to the first detection hole and a second sensor provided at a position corresponding to the second detection hole, and the first detection hole may be covered by a window member having light transmission properties, and the second detection hole may be opened when the second sensor is used, and the second detection hole may be closed by the shutter when the second sensor is not used.

The case may include an inner case forming the wall surface of the cooking chamber, and an outer case provided on the outside of the inner case, and the ventilation path may be arranged between the inner case and the outer case.

The ventilation path may include an upper flow path provided to extend from an intake port formed on an upper front surface of the case to the rear side of the case, the upper flow path limited by a duct coupled to an outer surface of the inner case, the upper flow path in which the detector and the shutter are received, a rear flow path formed between the inner case and the outer case at the rear of the case, and connected to the upper flow path, and a lower flow path formed between the inner case and the outer case at the lower side of the case, and configured to guide the air of the rear flow path to a discharge port formed on a lower front surface of the case.

The door may include an inner panel forming the wall surface of the cooking chamber, and an outer panel provided on the outside of the inner panel, and the ventilation path may be arranged between the inner panel and the outer panel.

The ventilation path may be provided to extend in a horizontal direction in the inside of the upper side of the door, and may include an intake port and a discharge port formed at opposite side ends of the door.

The intake port and the discharge port may be opened in a direction intersecting an opening and closing direction of the door.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
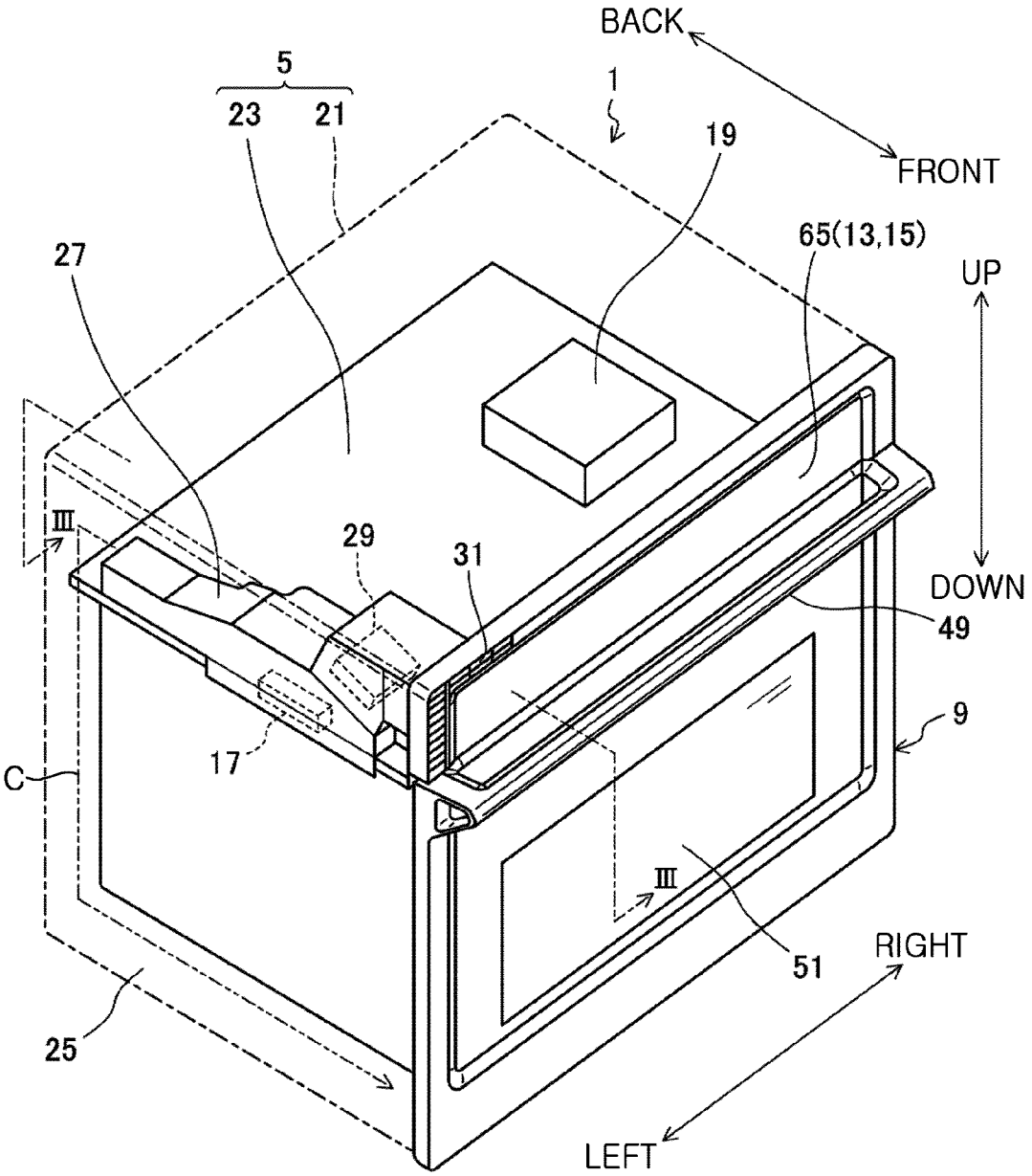
FIG. 1 illustrates a perspective view of a heating cooker according to a first embodiment of the disclosure.

FIGS. 1 through 14, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter a heating cooker according to embodiments of the disclosure will be described with reference to the drawings. In the drawing, "up" represents an upper side, "down" represents a lower side, "front" represents a door side, "rear" represents an opposite side of the door side, and "left" represents a left side and "right" represents a right side when viewed from a front surface of the door side.

Figure 2:
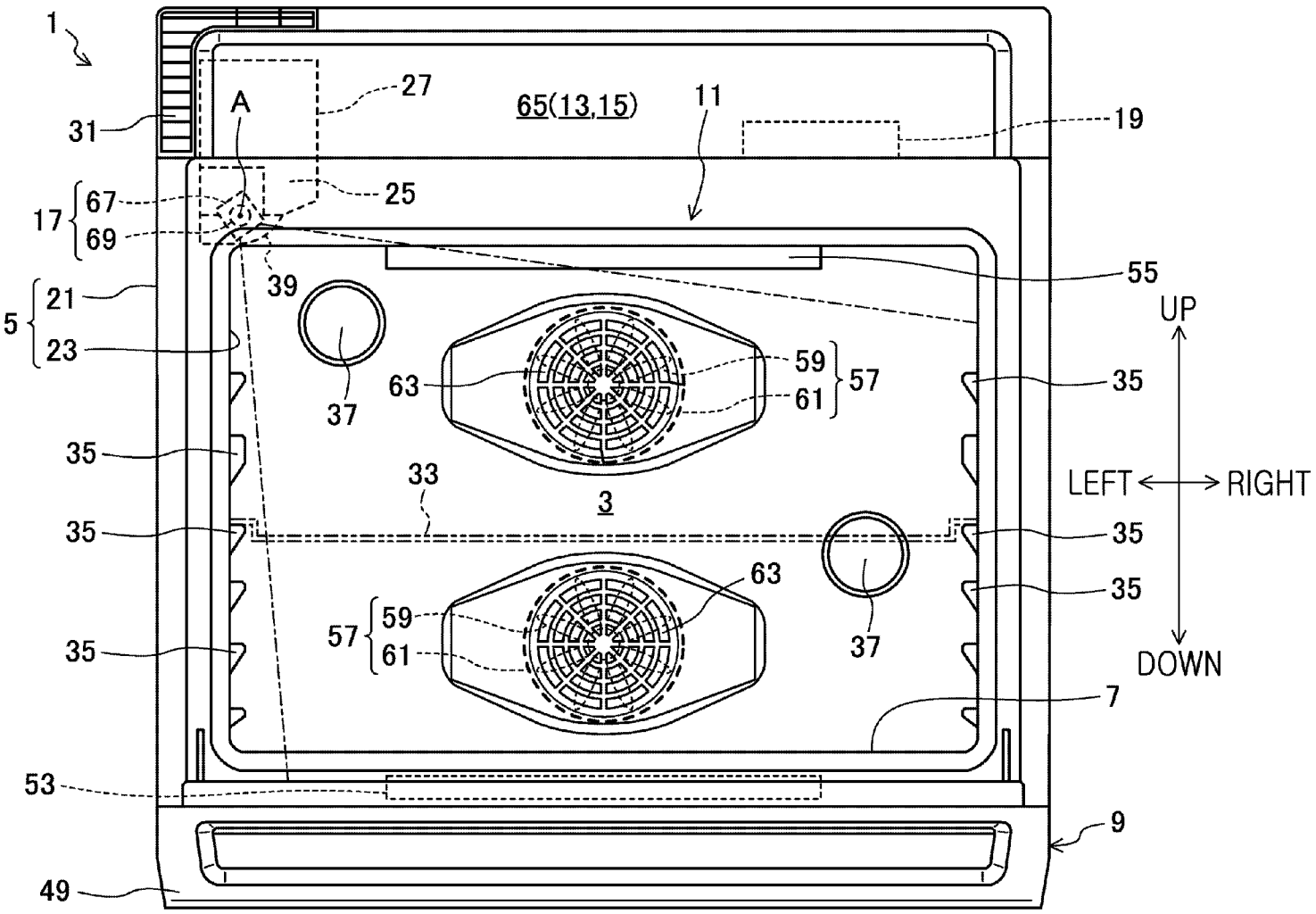
FIG. 2 illustrates a front view of the heating cooker according to the first embodiment of the disclosure, illustrating a state in which a door is opened.
Figure 3:
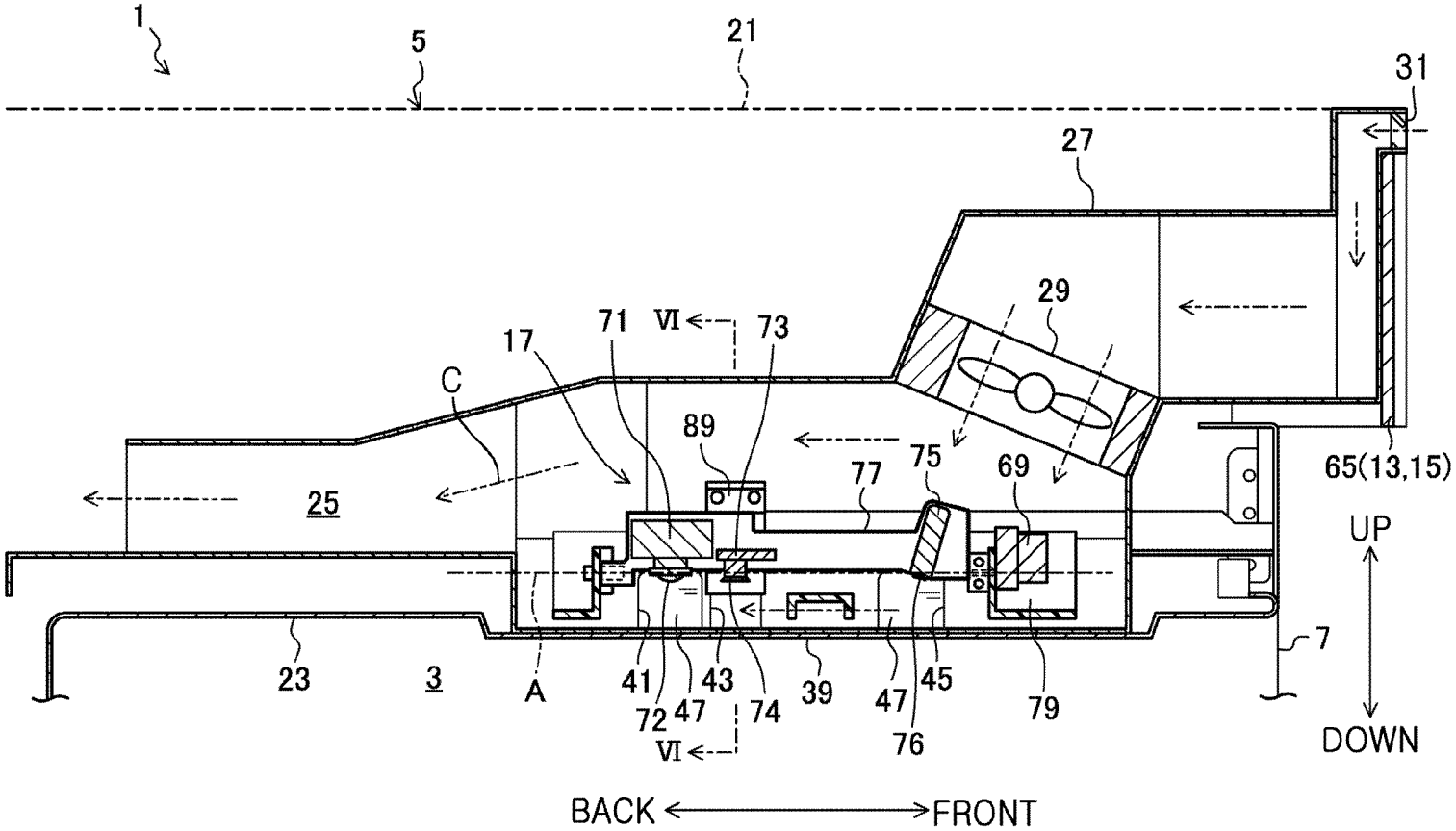
FIG. 3 illustrates a cross-sectional view taken along line of FIG. 1.
Figure 4:
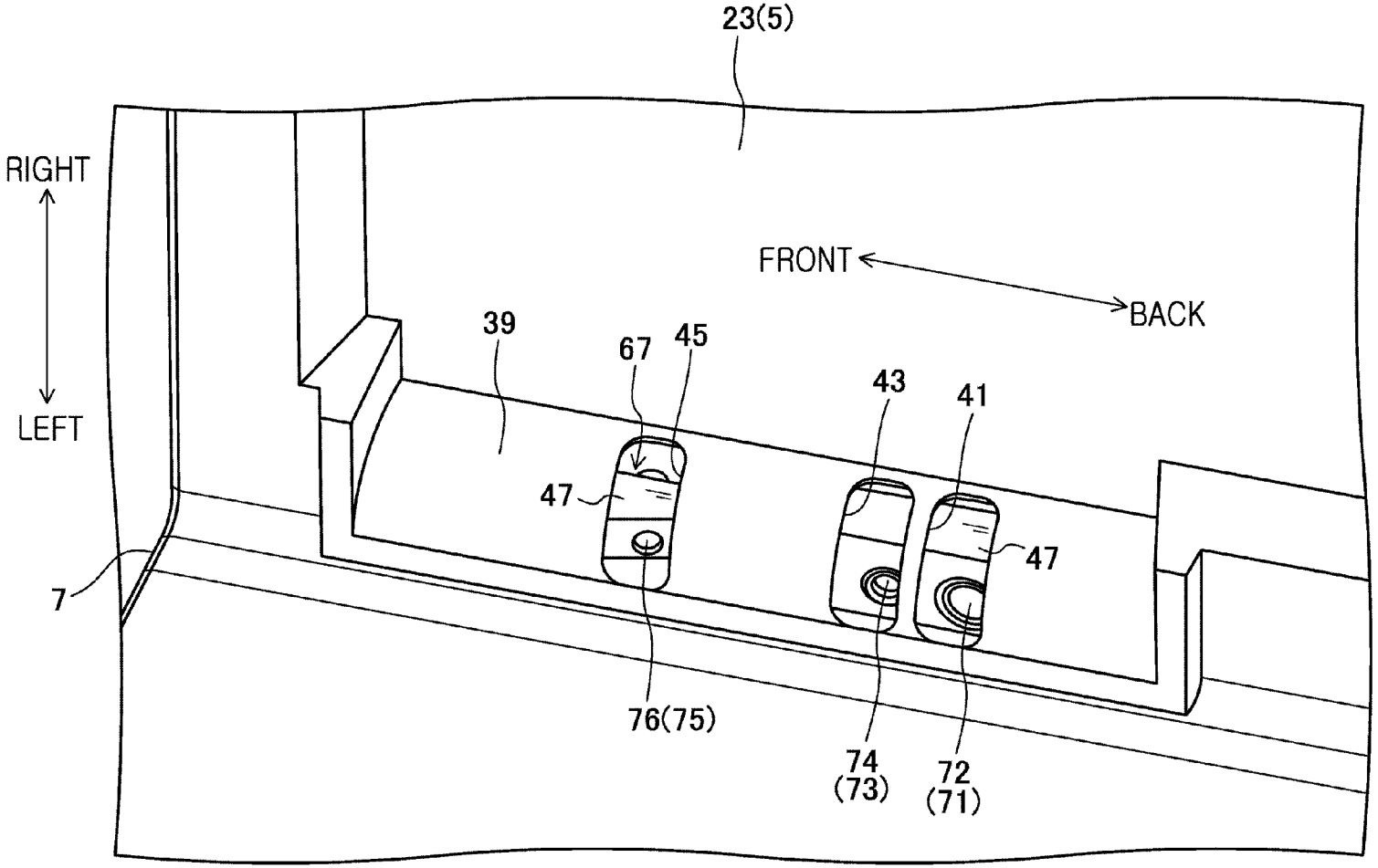
FIG. 4 illustrates a perspective view of a main portion of the heating cooker according to the first embodiment of the disclosure when viewed from the inside of a cooking chamber.
Figure 5:
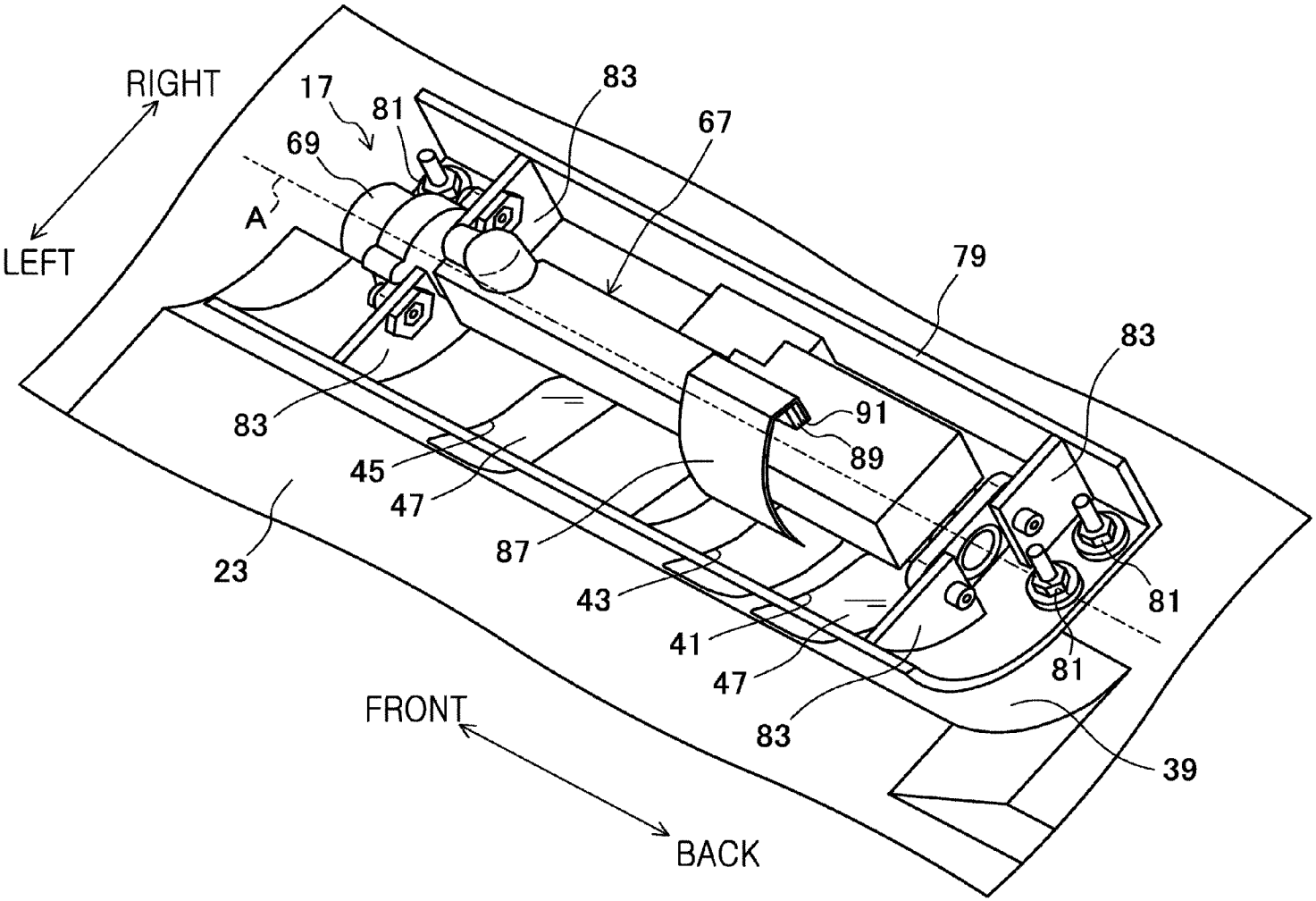
FIG. 5 illustrates a perspective view of the main portion of the heating cooker according to the first embodiment of the disclosure when viewed from the outside of the cooking chamber.
Figure 6:
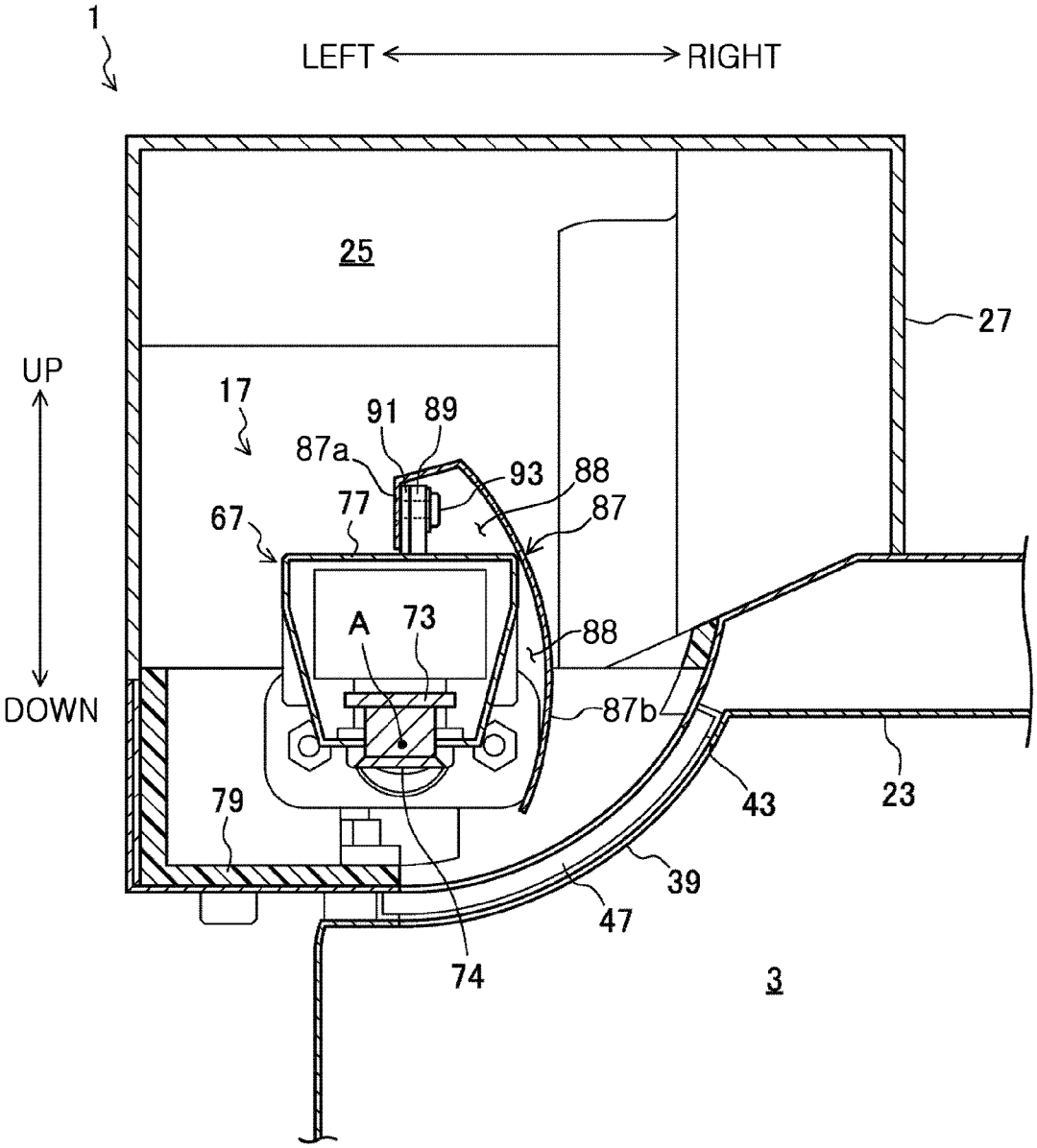
FIG. 6 illustrates a cross-sectional view taken along line VI-VI of FIG. 3.

FIG. 1 illustrates a perspective view of a heating cooker according to a first embodiment of the disclosure, FIG. 2 illustrates a front view of the heating cooker according to the first embodiment of the disclosure, illustrating a state in which a door is opened, FIG. 3 illustrates a cross-sectional view taken along line of FIG. 1, FIG. 4 illustrates a perspective view of a main portion of the heating cooker according to the first embodiment of the disclosure when viewed from the inside of a cooking chamber, FIG. 5 illustrates a perspective view of the main portion of the heating cooker according to the first embodiment of the disclosure when viewed from the outside of the cooking chamber, and FIG. 6 illustrates a cross-sectional view taken along line VI-VI of FIG. 3.

A heating cooker 1 refers to a convection oven. As shown in FIGS. 1 and 2, the heating cooker 1 may include a case 5 in which a cooking chamber 3 configured to receive an object to be heated is formed, a door 9 configured to open and close an opening 7 configured to allow an object to be heated to be put into or taken out of the cooking chamber of the case 5, a heater 11 configured to heat an object to be heated and received in the cooking chamber 3, a display 13 on which information related to heating cooking is displayed, an operator 15 for operation of the heating cooker 1, a detector 17 configured to detect information on the inside of the cooking chamber 3, and a controller 19 configured to control overall operation of the heating cooker 1.

The case 5 may have a rectangular parallelepiped, and may include the opening 7 on a front surface thereof. The case 5 includes an inner case 23 forming a wall surface of the cooking chamber 3 and an outer case 21 installed on the outside of the inner case 23 and forming an external shape of the heating cooker 1. The heater 11 and the controller 19 may be provided in a space between the outer case 21 and the inner case 23.

Referring to FIG. 2, the cooking chamber 3 may accommodate food materials such as meat, fish, and vegetables. A shelf 33 for loading food materials may be installed in the cooking chamber 3, and a plurality of shelf supports 35 for supporting and adjusting a height of the shelves 33 may be provided on the left and rear wall surfaces of the inner case 23. The plurality of shelf supports 35 may extend in the front and rear direction in a state of protruding toward the inner surface of the cooking chamber 3. Opposite ends of the shelf 33 may be selectively supported by the plurality of shelf supports 35 and thus the height of the shelf 33 may be adjusted in the cooking chamber 3.

As illustrated in FIG. 2, a lighting device 37 configured to emit light toward the inside of the cooking chamber 3 so as allow a state of food material to be identified during cooking may be installed on a rear wall of the cooking chamber 3. The lighting device 37 may include an incandescent lamp, a fluorescent lamp, or a light emitting diode (LED).

As illustrated in FIGS. 1 and 2, the door 9 may be connected to the case 5 in such a way that opposite sides of a lower portion of the door 9 are rotatably connected to opposite sides of a lower portion of the case 5 through a rotating shaft. Therefore, the door 9 may be rotated downward to open the opening 7 of the cooking chamber 3, and rotated upward to close the opening 7 of the cooking chamber 3.

The door 9 may include a handle 49 for opening and closing, and a see-through window 51 configured to allow a user to check a state of the food material in the cooking chamber 3 from the outside. The handle 49 may be in the form of a bar installed to extend in the left and right directions on the upper portion of the door 9. The see-through window 51 may be installed in a central portion of the door 9, and may be formed of a heat-resistant glass or a glass coated with a heat-reflecting material.

Referring to FIG. 2, the heater 11 may heat air inside the cooking chamber 3. The heater 11 may include a first heater 53, a second heater 55, and a third heater 57. Output of the first heater 53, the second heater 55, and the third heater 57 may be adjusted independently of each other.

The first heater 53 may be installed below the cooking chamber 3 in the inside of the case 5. The second heater 55 may be installed on a wall (ceiling) of the inner case 23 above the cooking chamber 3. The first heater 53 and the second heater 55 each may be a heating element configured to generate heat or an infrared heater configured to emit infrared rays into the cooking chamber. Alternatively, the first heater 53 and the second heater 55 each may be configured by a combination of a heating element and an infrared heater.

The third heater 57 may be installed on an upper side and a lower side of the rear wall of the cooking chamber 3, respectively. The third heater 57 may include a heating portion 59 configured to heat air and a circulation fan 61 configured to circulate air inside the cooking chamber 3 to allow the inside air of the cooking chamber to be heated by the heating portion 59. The circulation fan 61 may installed on the rear side of a blowing port 63 formed on the rear wall of the cooking chamber 3, and the heating portion 59 may be provided in such a way that a heating element, which generates heat by the application of the electric current, is installed in an annular shape around the circulation fan 61. Therefore, the air of the inside of the cooking chamber 3 may be heated by the heating portion 59 while being circulated by the operation of the circulation fan 61.

The display 13 and the operator 15 may correspond to an integrated control panel 65 provided above the opening 7 of the cooking chamber 3. The control panel 65 may include a display device configured to display information and a touch panel for touch manipulation. The display device may include a liquid crystal display (LCD), an organic light emitting diode (OLED) display, and the touch panel may include a capacitive touch screen.

The control panel 65 may display information regarding heating cooking. The information related to the heating cooking may include an output level of the heater 11, a time used for the heating cooking, an operation mode such as a manual cooking operation or an automatic cooking operation, or a piece of information indicating an execution of cleaning of the cooking chamber. The control panel 65 may receive information for cooking through a user's touch operation, or may command the start and stop of heating cooking and cleaning of the cooking chamber. The information manipulated through the control panel 65 is transmitted to the controller 19.

Referring to FIGS. 1 to 3, a ventilation path 25 extending along the wall surface of the cooking chamber 3 is provided between the inner case 23 and outer case 21. In addition, a cooling fan 29 configured to suck outside air and blow the outside air into the ventilation path 25 is installed in the ventilation path 25. The cooling fan 29 may include a propeller fan. The cooling fan 29 may be driven when the heating cooker 1 is operated, and may blow cooling air to a direction of an arrow C, as shown in FIGS. 1 and 3.

As illustrated in FIGS. 1 to 3, the ventilation path 25 may include an upper flow path limited to a duct 27 extending from an intake port 31 formed on the upper front surface of the case 5 to the rear side of the case 5, a rear flow path formed by a space between the inner case 23 and the outer case 21 at the rear of the case 5, and connected to the upper flow path, and a lower flow path formed by a space between the inner case 23 and the outer case 21 at the lower side of the case 5, and configured to guide the air of the rear flow path to a discharge port formed on the lower front surface of the case 5.

The ventilation path 25 is illustrated as extending in the front and rear direction in the upper left portion of the case 5 according to the first embodiment, but is not limited thereto. Alternatively, the ventilation path 25 may be installed on the central portion or the upper right portion of the case 5.

Referring to FIGS. 4 and 5, a sensor receiving portion 39 may be formed in such a way that a part of the ventilation path 25 extends to allow the detector 17 to be received therein, and the sensor receiving portion 39 may be installed in an upper corner of the inner case 23 (an upper left portion of the cooking chamber). The sensor receiving portion 39 may be formed to have a cross section in a circular arc shape, and the sensor receiving portion 39 may extend in the front and rear direction while protruding toward the inside of the cooking chamber 3. The sensor receiving portion 39 may secure a space for receiving the detector 17 therein by forming the ventilation path 25 that extends together with the duct 27.

As illustrated in FIGS. 3 to 5, the detector 17 includes a sensor unit 67 rotatably installed in the ventilation path 25 and configured to detect information on the inside of the cooking chamber 3, and a driver 69 configured to rotate the sensor unit 67. The driver 69 may be a motor configured to rotate the sensor unit 67 in the forward or reverse direction.

The sensor unit 67 may include a sensor housing 77 rotatably installed on a base member 79 fixed in the ventilation path 25, and a plurality of sensors installed on the sensor housing 77 and configured to detect information on the inside of the cooking chamber 3, and a light irradiator 75 installed in the sensor housing 77 and configured to emit visible light to the inside of the cooking chamber 3. The plurality of sensors may include a camera 71 corresponding to a first sensor and a temperature sensor 73 corresponding to a second sensor.

The sensor housing 77 may be formed of a resin material having low heat transfer properties. As illustrated in FIG. 3, the sensor housing 77 may be elongated in a longitudinal direction of the ventilation path, and a rotating shaft provided at opposite ends of the sensor housing is rotatably supported by the base member 79. Therefore, the sensor housing 77 may be rotated with respect a rotation axis A extending in the front and rear direction. An outer surface of the sensor housing 77 may be evenly cooled by cooling air flowing through the ventilation path 25 because the sensor housing 77 is spaced apart from the inner surface of the ventilation path 25. Further, it is possible to prevent the heat of the sensor receiving portion 39 from being transferred to the sensor housing 77 because the sensor housing 77 is spaced apart from the sensor receiving portion 39.

As illustrated in FIG. 5, the base member 79 may have a substantially semi-cylindrical shape, and an open portion may be disposed to face the inner surface of the duct 27. Opposite ends of the base member 79 may be fixed to the inner case 23 by a plurality of fastening members 81. The base member 79 is provided with a support plate 83 respectively provided on opposite sides of the base member 79 to rotatably support the sensor housing 77. The base member 79 may rotatably support the sensor housing 77 while separating the sensor housing 77 from the inner surface of the ventilation path 25. Further, the base member 79 may guide the cooling air to allow the cooling air to flow along the outside of the sensor unit 67, thereby improving the cooling efficiency of the sensor unit 67.

Referring to FIGS. 3 and 4, the sensor receiving portion 39 includes a first detection hole 41, a second detection hole 43, and a third detection hole 45 which pass through the ventilation path 25 and the cooking chamber 3. The first detection hole 41, the second detection hole 43, and the third detection hole 45 may be formed at intervals in the front and rear direction, and may be elongated in a direction along a curved surface of the sensor receiving portion 39. A distance between the first detection hole 41 and the second detection hole 43 may be less than a distance between the second detection hole 43 and the third detection hole 45.

The first detection hole 41 is formed at a position corresponding to an imaging surface 72 of the camera 71 (a detection surface of the first sensor), and the second detection hole 43 is formed at a position corresponding to a detection surface 74 of the temperature sensor 73 (a detection surface of the second sensor). The third detection hole 45 is formed at a position corresponding to a light emitting surface 76 of the light irradiator 75. Therefore, the camera 71 may obtain image information on food materials placed in the cooking chamber 3 through the first detection hole 41, and the temperature sensor 73 may measure a temperature of an object to be heated in the cooking chamber 3 through the second detection hole 43. The light irradiator 75 may emit light into the cooking chamber 3 through the third detection hole 45.

The camera 71 may include a charge-coupled device (CCD) camera, or a complementary metal-oxide semiconductor (CMOS) camera. A focal length or an angle of view of the camera 71 may be set to image the entire front and rear direction of the food material placed on the shelf 33 of the cooking chamber 3. The image information obtained by the camera 71 is transmitted to the controller 19.

In order to automatically identify the type of food material, the camera 71 may image an entire of the food material in the cooking chamber 3 and transmit the image information to the controller 19. In addition, the camera 71 may also obtain three dimensional information of food materials placed in the cooking chamber 3 in cooperation with the light irradiator 75. The three-dimensional information of the food material includes a three-dimensional shape represented by three-dimensional coordinates of the food material. The camera 71 and the light irradiator 75 may constitute a three-dimensional measuring device configured to measure the three-dimensional shape of the food material.

The light irradiator 75 may include a semiconductor laser, and through the third detection hole 45, the light irradiator 75 may emit visible light having a predetermined wavelength to the food material placed in the cooking chamber 3. The light irradiator 75 may change the wavelength of the irradiated light. To this end, the light irradiator 75 may include a plurality of semiconductor lasers configured to emit light rays of different colors, or a mechanism configured to change the wavelength.

The light irradiator 75 may change visible light emitted by the semiconductor laser into a predetermined pattern and output the visible light in the predetermined pattern. The light irradiator 75 emits visible light, which spreads radially, toward the food material in the cooking chamber 3, and the camera 71 images the visible light emitted by the light irradiator 75. The three-dimensional measuring device may measure a three-dimensional shape of the food material using the principle of triangulation based on the visible light obtained by the camera 71.

The first detection hole 41 and the third detection hole 45 are covered by a window member 47 having light transmission properties. The window member 47 may be a heat-resistant glass capable of withstanding a temperature of the heated cooking chamber 3 and having excellent light transmittance. The first detection hole 41 and the third detection hole 45 are maintained in a state of being covered by the window member 47. Therefore, the imaging surface 72 of the camera 71 and the light emitting surface 76 of the light irradiator 75 are not contaminated by steam or food residue of the inside of the cooking chamber 3.

The temperature sensor 73 may measure heat distribution of the food materials placed in the cooking chamber 3 through the second detection hole 43 and detect a surface temperature of the food materials in a non-contact manner. The temperature sensor 73 may be an infrared sensor configured to detect infrared rays emitted to a detection target region. Temperature information detected by the temperature sensor 73 is transmitted to the controller 19.

When the temperature sensor 73 is covered by the window member such as a heat-resistant glass, electromagnetic waves may be attenuated in the process of passing through the window member, and thus the surface temperature of the food material may not be accurately detected. Therefore, the window member is not installed in the second detection hole 43.

However, when the second detection hole 43 is kept open even when the camera 71 and the temperature sensor 73 are not used, steam or food residue in the cooking chamber 3 may be moved to the sensor unit 67 side through the second detection hole 43 and thus the steam or food residue may contaminate the detection surface 74 of the temperature sensor 73 and the imaging surface 72 of the camera 71. Therefore, the heating cooker 1 according to the first embodiment includes a shutter 87 configured to close the second detection hole 43 when the camera 71 and the temperature sensor 73 are not used.

Figure 7:
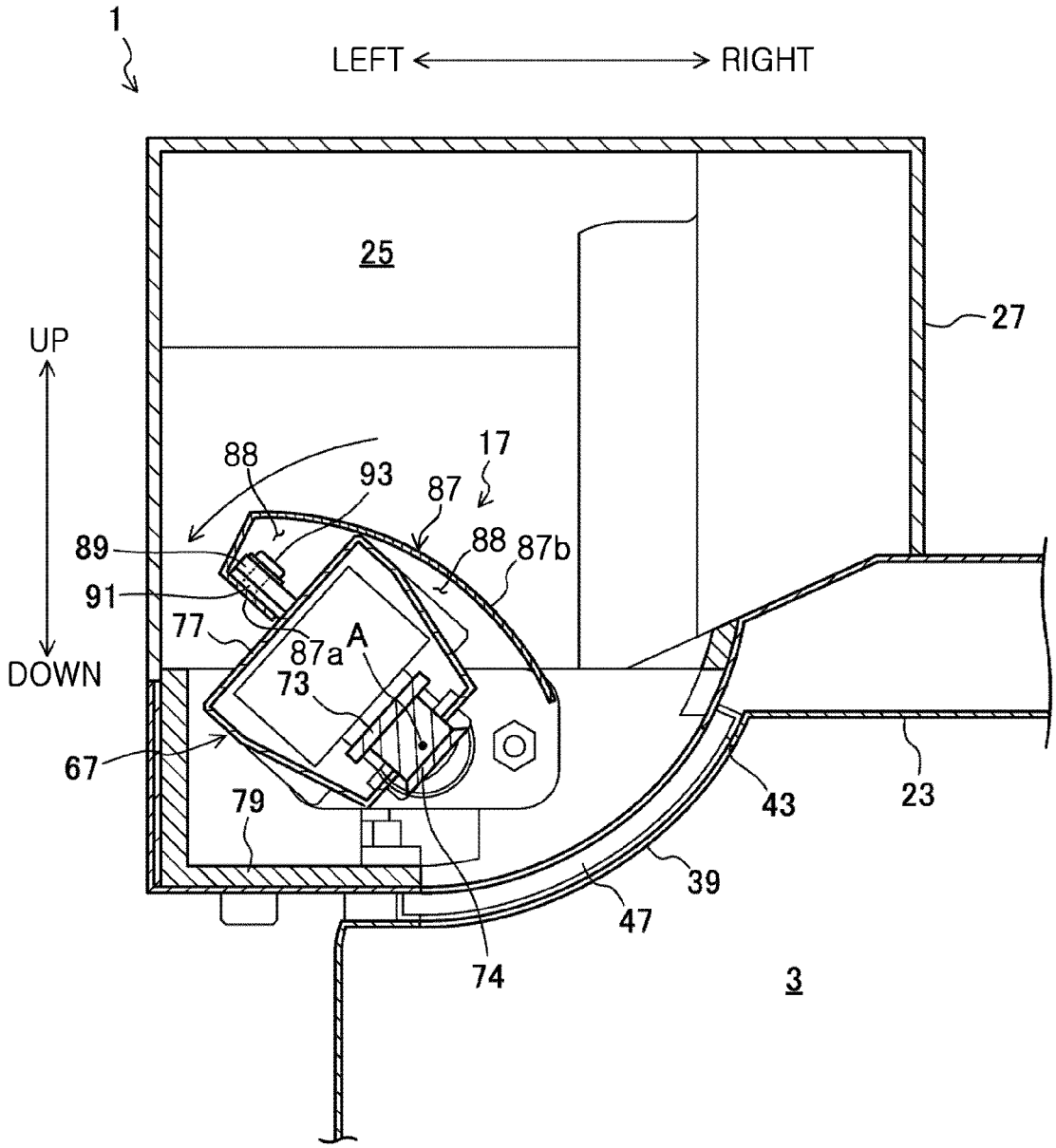
FIG. 7 illustrates a cross-sectional view taken along line VI-VI of FIG. 3, illustrating a state in which a sensor unit is rotated to be a state in which a sensor is used.
Figure 8:
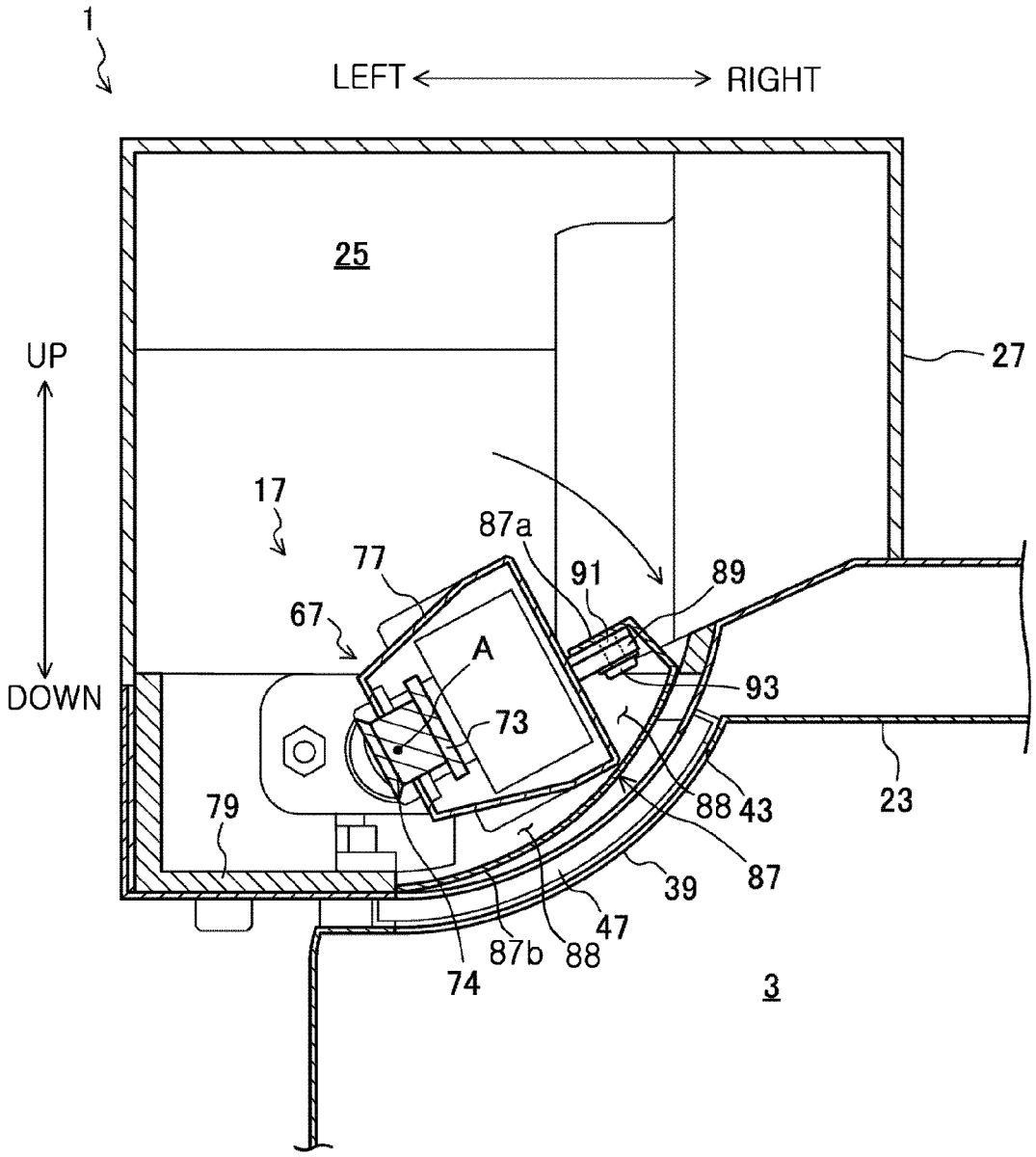
FIG. 8 illustrates a cross-sectional view taken along line VI-VI of FIG. 3, illustrating a state in which the sensor unit is rotated to be a state in which the sensor is not used.

The shutter 87 may be mounted on the sensor unit 67 to be rotated together with the sensor unit 67 upon the rotation of the sensor unit 67, as illustrated in FIG. 6. As illustrated in FIG. 7, the shutter 87 may open the second detection hole 43 when the detection surface 74 of the temperature sensor 73 is rotated to a first position in which the detection surface 74 of the temperature sensor 73 faces the second detection hole 43. As illustrated in FIG. 8, the shutter 87 may close the second detection hole 43 when the detection surface 74 of the temperature sensor 73 is rotated to a second position in which the detection surface 74 of the temperature sensor 73 does not face the second detection hole 43.

The shutter 87 may include a fixer 87*a* fastened to a bracket 89 formed on the outer surface of the sensor housing 77, and an opening and closing portion 87*b* extending from the fixer 87*a* to open and close the second detection hole 43.

In a state in which an insulating member 91 is interposed therebetween, the fixer 87*a* is fixed to the bracket 89 by fastening a fixing screw 93. The opening and closing portion 87*b* extends from the fixer 87*a* to cover the outside of the sensor housing 77, and the opening and closing portion 87*b* is bent in a shape corresponding to the inner surface of the sensor receiving portion 39 in which the second detection hole 43 is placed.

The fixer 87*a* and the opening and closing portion 87*b* of the shutter 87 may be integrally provided by bending a flat material having excellent heat resistance such as enamel. The sensor housing 77 may be formed of a resin material having a lower heat transfer property than the shutter 87. The insulating member 91 interposed between the fixer 87*a* and the bracket 89 may be a mica plate having excellent heat insulating property. The insulating member 91 prevents heat being transferred from the shutter 87 to the sensor housing 77. Therefore, as shown in FIG. 8, the heating cooker 1 may prevent the heat from being transferred to the sensor unit 67 side even when the opening and closing portion 87*b* of the shutter 87, which closes the second detection hole 43, is heated by the heat of the cooking chamber 3.

The opening and closing portion 87*b* of the shutter 87 is spaced from the outer surface of the sensor housing 77 so as to form a space 88, through which the cooling air passes is formed, between the outer surface and the inner surface of the sensor unit 67. Therefore, the sensor unit 67 and the shutter 87 are sufficiently cooled by the cooling air flowing through the ventilation path 25 in the state of FIG. 8 in which the shutter 87 closes the second detection hole 43 as well as in the state of FIG. 7.

As shown in FIG. 3, the driver 69 is installed at one end side of the sensor unit 67. By rotating the sensor unit 67 within a predetermined angle range, the driver 69 may displace the imaging surface 72 of the camera 71, the detection surface 74 of the temperature sensor 73, and the light emitting surface 76 of the light irradiator 75 to a use position (a first position) as illustrated in FIG. 7 or to a non-use position (a second position) as illustrated in FIG. 8.

The use position of the sensor unit 67 is a position in which the imaging surface 72 of the camera 71 faces the first detection hole 41, the detection surface 74 of the temperature sensor 73 faces the second detection hole 43, and the light emitting surface 76 of the light irradiator 75 faces the third detection hole 45. The non-use position of the sensor unit 67 is a position in which the imaging surface 72 of the camera 71 faces a direction different from the first detection hole 41, the detection surface 74 of the temperature sensor 73 faces a direction different from the second detection hole 43, and the light emitting surface 76 of the light irradiator 75 faces a direction different from the third detection hole 45. When the sensor unit 67 is in the non-use position, the second detection hole 43 is closed by the shutter 87 as shown in FIG. 8.

The controller 19 is electrically connected to communicate with the heater 11, the display 13, the operator 15, and the detector 17 of the heating cooker 1. The controller 19 may be a conventional microcomputer. The controller 19 includes a Central Processing Unit (CPU) for executing a program, and a memory for storing various programs and data executed in the CPU. By executing a program stored in the memory, the controller 19 may perform heating cooking or cleaning of the cooking chamber based on information set through the control panel 65 and information on the inside of the cooking chamber 3 detected by the detector 17.

The controller 19 may drive the driver 69 so as to switch the position of the imaging surface 72 of the camera 71, the detection surface 74 of the temperature sensor 73, and the light emitting surface 76 of the light irradiator 75 to the non-use position. That is, during a manual cooking operation that does not detect information on the inside of the cooking chamber 3 by the camera 71, the temperature sensor 73 or the three-dimensional measuring device, and a period of time, which is except a time for detecting information on the inside of the cooking chamber 3, during an automatic cooking operation that detects information on the inside of the cooking chamber 3, the controller 19 may switch the position of the sensor unit 67 to the non-use position Accordingly, by allowing the sensor unit 67 to switch to the non-use position, the controller 19 may protect the camera 71, the temperature sensor 73, and the light irradiator 75 from heat of the inside of the cooking chamber 3 and by closing the second detection hole 43 with the shutter 87, the controller 19 may prevent the imaging surface 72 of the camera 71, the detection surface 74 of the temperature sensor 73, and the light emitting surface 76 of the light irradiator 75 from being contaminated.

The heating cooker 1 may perform a cleaning function called pyrolytic cleaning. Pyrolytic cleaning heats the inside of the cooking chamber 3 to 420° C. or higher to clean up contamination such as grease by pyrolysis. Therefore, the camera 71, the temperature sensor 73, and the light irradiator 75 of the sensor unit 67 may be deteriorated or damaged by heat of the inside of the cooking chamber 3 when performing the pyrolytic cleaning.

Upon the pyrolytic cleaning as described above, the controller 19 may drive the driver 69 so as to switch the position of the imaging surface 72 of the camera 71, the detection surface 74 of the temperature sensor 73, and the light emitting surface 76 of the light irradiator 75 into the non-use position, thereby protecting the camera 71, the temperature sensor 73, and the light irradiator 75 from the heat of the cooking chamber 3. At the same time, by closing the second detection hole 43 with the shutter 87, the controller 19 may prevent the imaging surface 72 of the camera 71, the detection surface 74 of the temperature sensor 73, and the light emitting surface 76 of the light irradiator 75 from being contaminated.

The controller 19 drives the cooling fan 29 when the operation of the heating cooker 1 (heating cooking or cleaning of the cooking chamber) is started. The sensor unit 67 and the shutter 87 are cooled together by the cooling air distributed in the ventilation path 25 by the driving of the cooling fan 29. The cooling air flowing through the ventilation path 25 cools the camera 71, the temperature sensor 73, the light irradiator 75, and each window member 47 by passing between the imaging surface 72 of the camera 71 and the window member 47 installed in the first detection hole 41, between the detection surface 74 of the temperature sensor 73 and the second detection hole 43, and between the light emitting surface 76 of the light irradiator 75 and the window member 47 installed in the third detection hole 45. In order to protect the sensor unit 67 from the heat of the cooking chamber 3, the heating cooker 1 distributes the cooling air to the sensor unit 67 and the vicinity of the sensor unit 67, thereby cooling the sensor unit 67.

As for the heating cooker 1 according to the first embodiment, the shutter 87 opens and closes the second detection hole 43 according to whether the sensor unit 67 is used. Accordingly, when the sensor unit 67 is not used, the camera 71, the temperature sensor 73, and the light irradiator 75 may be protected from heat of the cooking chamber 3, and at the same time, the imaging surface 72 of the camera 71, the detection surface 74 of the temperature sensor 73 and the light emitting surface 76 of the light irradiator 75 may be prevented from being contaminated.

The heating cooker 1 according to the first embodiment cools the shutter 87 and the sensor unit 67 together by distributing the cooling air through the ventilation path 25. Therefore, even when the shutter 87 is exposed to hot air convection in the inside of the cooking chamber 3 in a state in which the sensor unit 67 is not used, it is possible to easily cool the sensor unit 67 and the shutter 87 and it is possible to minimize the heat that is transferred from the shutter 87 to the sensor unit 67. Accordingly, it is possible to prevent the camera 71, the temperature sensor 73, and the light irradiator 75 from being deteriorated or damaged caused by the temperature rise.

Because the heating cooker 1 according to the first embodiment distributes the cooling air between the camera 71 and the window member 47 installed in the first detection hole 41, the temperature rise in the space between the camera 71 and the window member 47 may be prevented while the camera 71 is brought close to the window member 47. Therefore, it is possible to prevent the camera 71 from being over heated by the heat of the inside of the cooking chamber 3. Further, because the camera 71 is brought close to the window member 47, it is possible to secure a wide range for detecting information on the inside of the cooking chamber 3 while reducing a size of the first detection hole 41.

Because the heating cooker 1 according to the first embodiment distributes the cooling air between the light irradiator 75 and the window member 47 installed in the third detection hole 45, the temperature rise in the space between the light irradiator 75 and the window member 47 may be prevented while light irradiator 75 is brought close to the window member 47. Therefore, it is possible to prevent the light irradiator 75 from being over heated by the heat of the inside of the cooking chamber 3. Further, because the light irradiator 75 is brought close to the window member 47, it is possible to secure a wide range for emitting visible light in the inside of the cooking chamber 3 while reducing a size of third detection hole 45.

The heating cooker 1 according to the first embodiment may prevent the imaging surface 72 of the camera 71, the detection surface 74 of the temperature sensor 73, and the light emitting surface 76 of the light irradiator 75 from facing the first detection hole 41, the second detection hole 43 and the third detection hole 45, respectively when the sensor unit 67 is not used. Accordingly, it is possible to protect the imaging surface 72 of the camera 71, the detection surface 74 of the temperature sensor 73, and the light emitting surface 76 of the light irradiator 75 from the heat of the inside of the cooking chamber 3.

As for the heating cooker 1 according to the first embodiment, the shutter 87 is installed in the sensor unit 67. Therefore, by using the single driver 69, the heating cooker 1 may perform switching of the position of the imaging surface 72 of the camera 71, the detection surface 74 of the temperature sensor 73, and the light emitting surface 76 of the light irradiator 75 and perform opening and closing of the second detection hole 43 by the shutter 87. Therefore, it is possible to reduce the number of components so as to make the heating cooker 1 compact.

As for the heating cooker 1 according to the first embodiment, the wall surface of the cooking chamber 3, on which the sensor unit 67 is installed, includes the sensor receiving portion 39 having the circular arc shape that is along the rotational trajectory of the sensor unit 67. Therefore, although the first to third detection holes 41, 43, and 45 are relatively small, the heating cooker 1 according to the first embodiment may secure a wide range, in which the camera 71, the temperature sensor 73, and the three-dimensional measuring device detect the information on the inside of the cooking chamber 3, and reduce the effect of the heat of the inside of the cooking chamber 3 applied to the camera 71, the temperature sensor 73 and the light irradiator 75, regardless of the change in the direction of the imaging surface 72 of the camera 71, the detection surface 74 of the temperature sensor 73, and the light emitting surface 76 of the light irradiator 75 according to the rotation of the sensor unit 67.

The heating cooker 1 according to the first embodiment may prevent the heat of the shutter 87, which is exposed to the high temperature air, from being transferred to the sensor unit 67 because the insulating member 91 is installed at the connection portion between the sensor unit 67 and the shutter 87. Therefore, the heating cooker 1 may prevent the camera 71, the temperature sensor 73, and the light irradiator 75 from being damaged caused by the temperature rise, and may improve the durability of the sensor unit 67.

In a heating cooker 1 according to a second embodiment, an installation position of a detector 17 configured to detect information on the inside of a cooking chamber 3 is different from the installation position of the detector 17 according to the first embodiment. In the second embodiment, except for the heater and components related to the heater, components are substantially the same as the first embodiment, and thus the heater and the components related to the heater will be mainly described. A description of other component will refer to the description of the first embodiment based on FIGS. 1 to 8.

Figure 9:
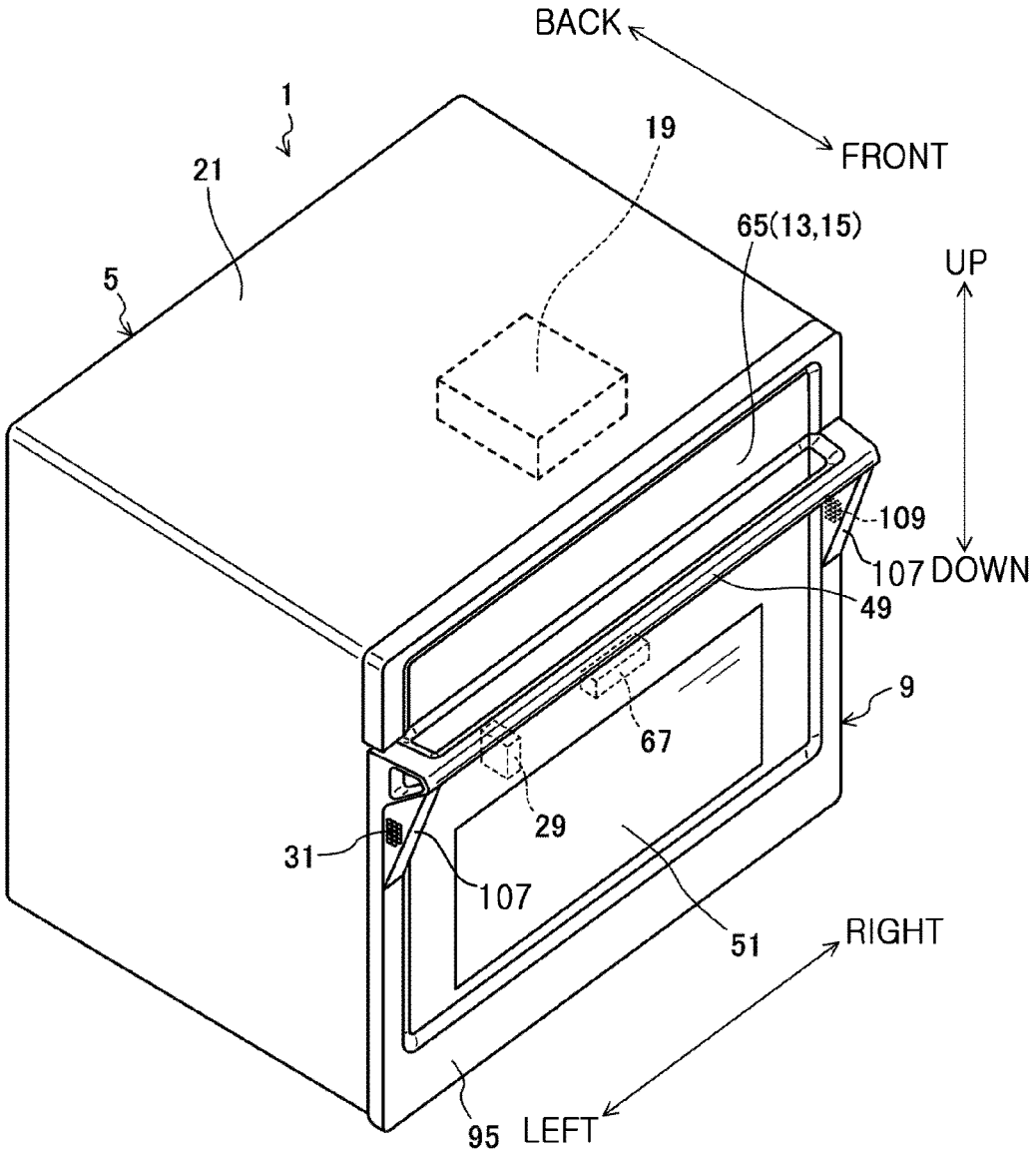
FIG. 9 illustrates a perspective view of a heating cooker according to a second embodiment of the disclosure.
Figure 10:
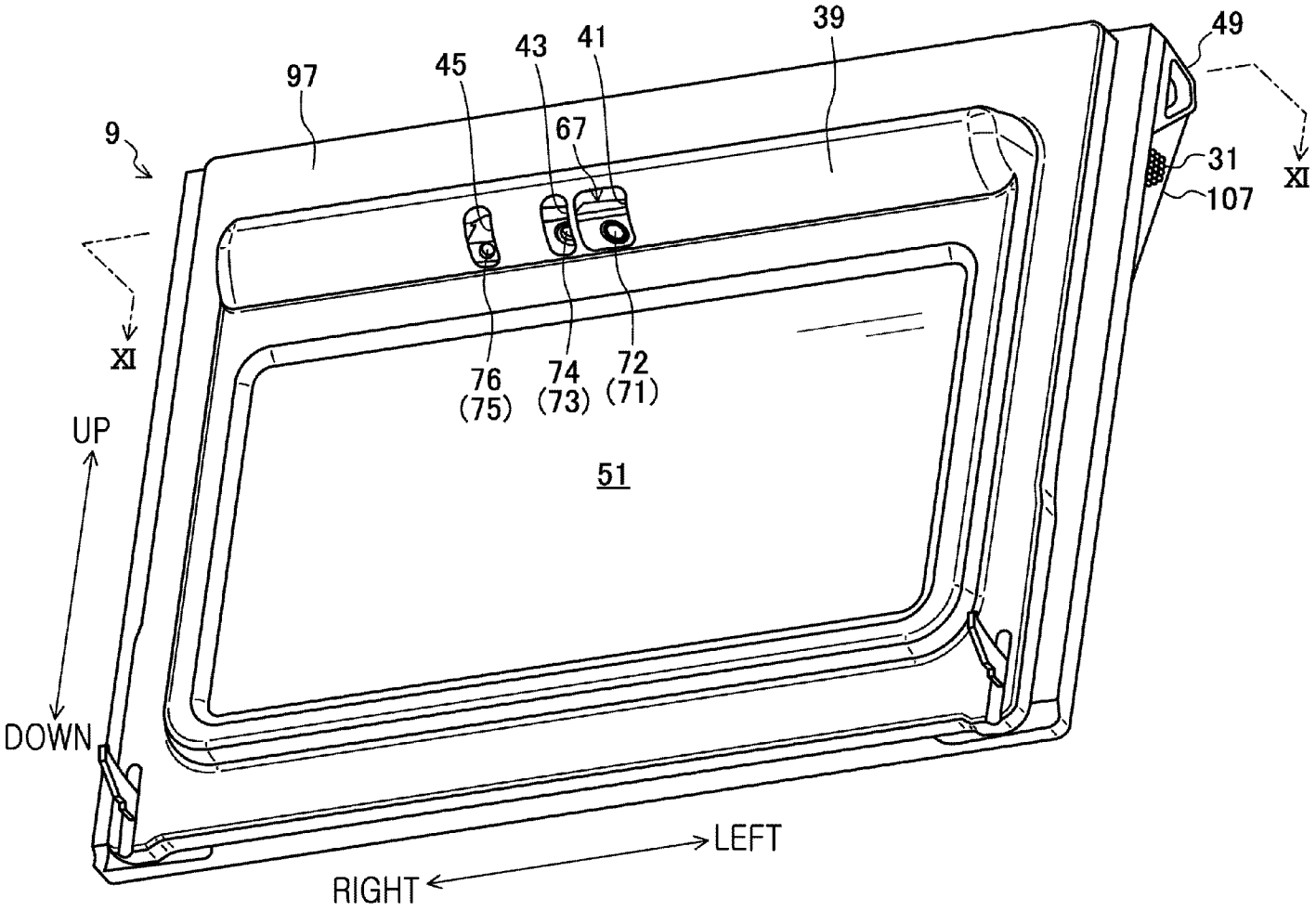
FIG. 10 illustrates a perspective view of a rear surface of a door of the heating cooker according to the second embodiment of the disclosure.
Figure 11:
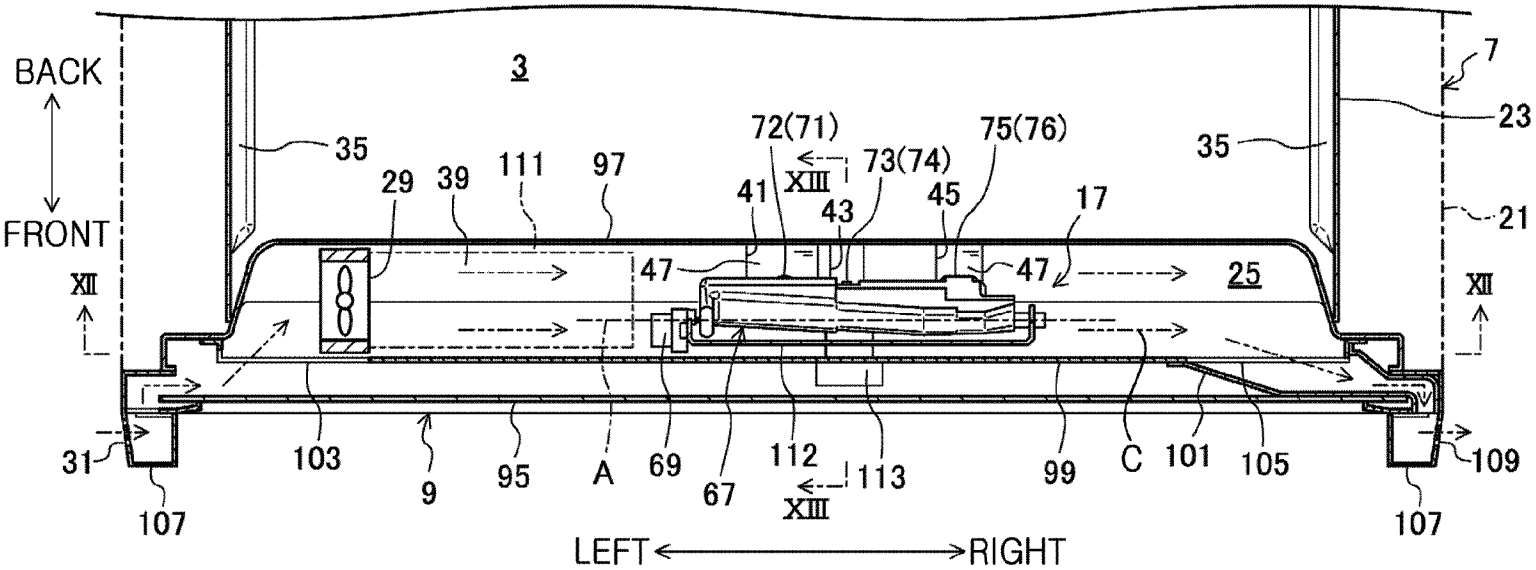
FIG. 11 illustrates a cross-sectional view taken along line XI-XI of FIG. 10.
Figure 12:
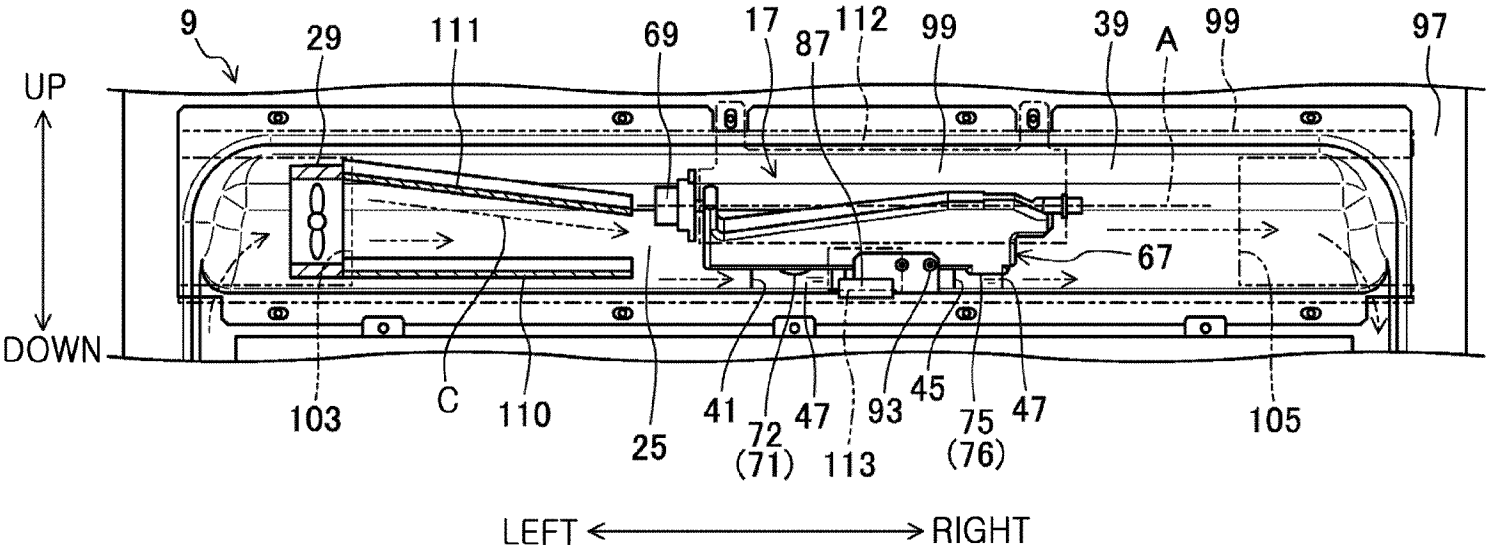
FIG. 12 illustrates a cross-sectional view taken along line XII-XII of FIG. 11.
Figure 13:
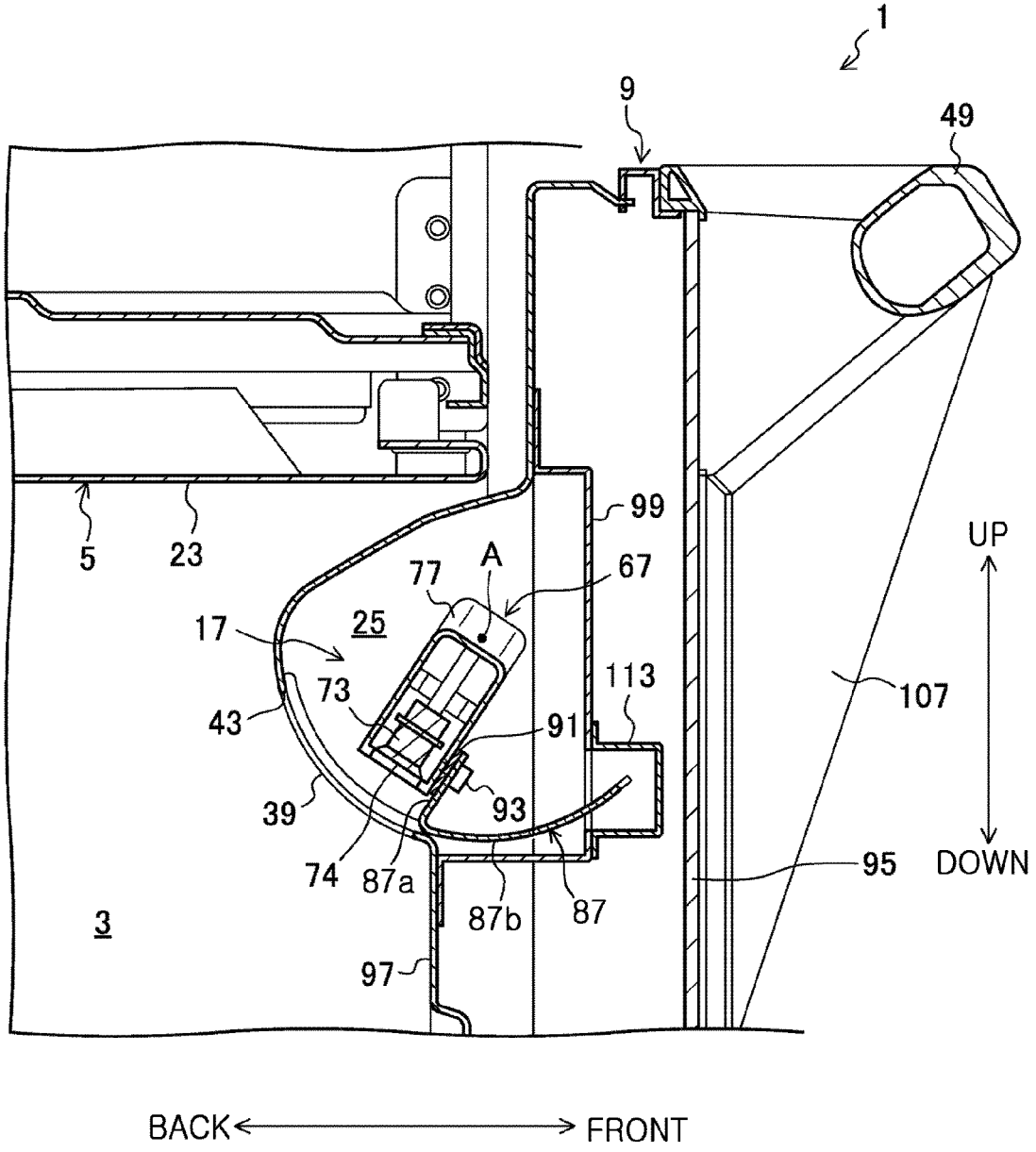
FIG. 13 illustrates a cross-sectional view taken along line XIII-XIII of FIG. 11, illustrating a state in which a sensor unit is rotated to be a state in which a sensor is used.
Figure 14:
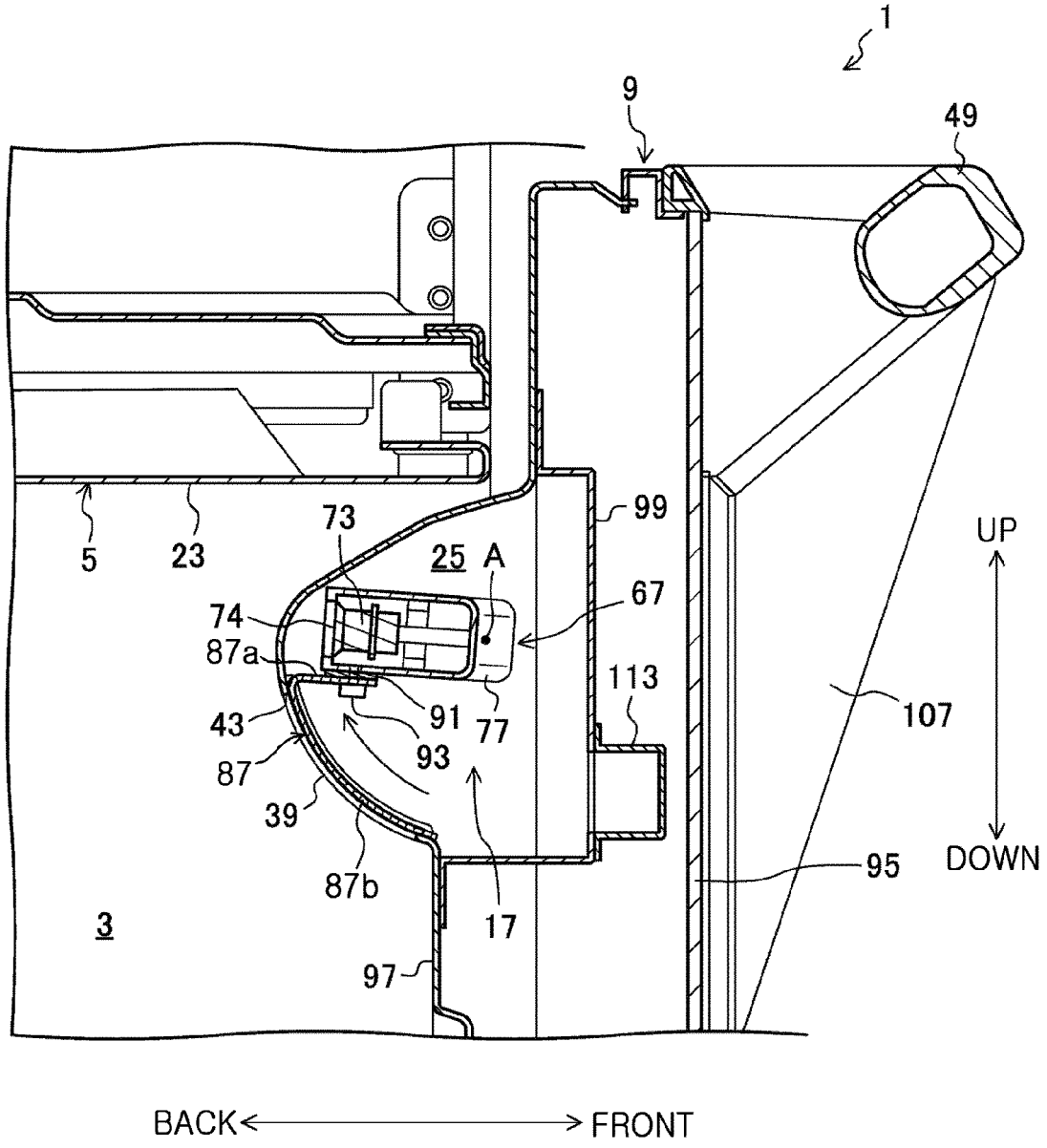
FIG. 14 illustrates a cross-sectional view taken along line XIII-XIII of FIG. 11, illustrating a state in which the sensor unit is rotated to be a state in which the sensor is not used.

FIG. 9 illustrates a perspective view of a heating cooker according to a second embodiment of the disclosure, FIG. 10 illustrates a perspective view of a rear surface of a door of the heating cooker according to the second embodiment of the disclosure, FIG. 11 illustrates a cross-sectional view taken along line XI-XI of FIG. 10, FIG. 12 illustrates a cross-sectional view taken along line XII-XII of FIG. 11, FIG. 13 illustrates a cross-sectional view taken along line XIII-XIII of FIG. 11, illustrating a state in which a sensor unit is rotated to be a state in which a sensor is used, and FIG. 14 illustrates a cross-sectional view taken along line XIII-XIII of FIG. 11, illustrating a state in which the sensor unit is rotated to be a state in which the sensor is not used.

According to the second embodiment, the heating cooker 1 includes a ventilation path 25 provided on an upper side of a door 9 so as to extend in the left and right direction along a wall surface of the cooking chamber 3, and a detector 17 installed in the inside of the ventilation path 25 and provided with a sensor unit 67, as shown in FIGS. 9 to 11.

The door 9 includes an inner panel 97 forming the wall surface of the cooking chamber 3, an outer panel 95 provided on the outside of the inner panel 97 so as to form a part forming the front surface thereof, and a main duct member 99 and a discharge duct member 101 that are arranged between the inner panel 97 and the outer panel 95. The ventilation path 25 is provided between the outer panel 95 and the inner panel 97. A part of the ventilation path 25 is formed by the main duct member 99 and the discharge duct member 101.

The main duct member 99 includes an inlet 103 on a front side of a left end, and an outlet 105 on the front side of a right end. The discharge duct member 101 is installed to cover the outlet 105 of the main duct member 99, and forms a downstream side part of the ventilation path 25. A part of the ventilation path 25, which is positioned in an upstream than the main duct member 99, is formed by a space between the outer panel 95 and the inner panel 97.

Referring to FIGS. 9 and 11, a hollow passage member 107 in communication with the ventilation path 25 is installed below opposite ends of the handle 49, respectively. An intake port 31 through which the outside air flows into the ventilation path 25 is formed on a left surface of the passage member 107 located below the left portion of the handle 49, and a discharge port 109 through which the air of the inside of the ventilation path 25 is discharged is formed on a right surface of the passage member 107 located below the right portion of the handle 49. The intake port 31 and the discharge port 109 include a plurality of openings formed in a circular shape, respectively. The intake port 31 and the discharge port 109 are open in a direction intersecting an opening direction of the door 9.

The ventilation path 25 is formed in a shape in which the intake port 31, the passage member 107 on the left side, the inlet 103 of the main duct member 99, an inner space of the main duct member 99, the outlet 105 of the main duct member 99, an inner space of the discharge duct member 101, the passage member 107 on the right side, and the discharge port 109 communicate with each other.

Referring to FIGS. 10 to 13, the inner panel 97 of the door 9 includes a sensor receiving portion 39 provided on an upper portion of the inner panel 97 to form the ventilation path 25 together with the main duct member 99. The sensor receiving portion 39 includes a cross section formed in a circular arc shape. The sensor receiving portion 39 protrudes toward the inside of the cooking chamber 3 and extends in the left and right directions. The sensor receiving portion 39 may secure a space for the installation of the detector 17 therein by forming the ventilation path 25 extending together with the main duct member 99. The sensor receiving portion 39 forms the inner wall surface of the cooking chamber 3 at the position in which the sensor unit 67 of the detector 17 is installed, and the inner surface of the sensor receiving portion 39 is provided in a circular arc shape corresponding to a rotational trajectory of the sensor unit 67.

The sensor receiving portion 39 includes a first detection hole 41, a second detection hole 43, and a third detection hole 45 which penetrate the inner panel 97. In the same manner as the first embodiment, the first detection hole 41, the second detection hole 43, and the third detection hole 45 may be formed at intervals in the left and right directions and may be elongated along the curved surface of the sensor receiving portion 39. A window member 47 formed of heat-resistant glass having light transmission property is installed in the first detection hole 41 and the third detection hole 45, but the window member 47 is not installed in the second detection hole 43.

The detector 17 configured to detect information on the inside of the cooking chamber 3, a cooling fan 29 configured to suck outside air and blow the outside air to the ventilation path 25, a partition plate 110 configured to reduce an area of a cross section of a flow path of the ventilation path 25, and an air guide member 111 configured to guide the cooling air, which is blown by the cooling fan 29, to the sensor unit 67 and the shutter 87 of the detector 17 are installed in the ventilation path 25.

The cooling fan 29 is arranged on the upstream side of the ventilation path 25. The cooling fan 29 is driven when the heating cooker 1 is operated, and the cooling fan 29 blows cooling air to a direction of an arrow C as illustrated in FIGS. 11 and 12.

In the same manner as the first embodiment, the detector 17 includes the sensor unit 67 rotatably installed in the ventilation path 25 and a driver 69 configured to rotate the sensor unit 67. The driver 69 may be a motor configured to rotate the sensor unit 67 in the forward or reverse direction.

The sensor unit 67 includes a camera 71, a temperature sensor 73, and a light irradiator 75, and a sensor housing 77 configured to receive and support the camera 71, the temperature sensor 73, and the light irradiator 75. The sensor housing 77 is rotatably supported by a bracket 112 fixed to the inner panel 97. Therefore, the sensor unit 67 may be rotated with respect an axis A extending in the left and right directions. An outer surface of the sensor housing 77 may be evenly cooled by cooling air flowing through the ventilation path 25 because the sensor housing 77 is spaced apart from the inner surface of the ventilation path 25. Further, it is possible to prevent the heat of the sensor receiving portion 39 from being transferred to the sensor housing 77 because the sensor housing 77 is spaced apart from the sensor receiving portion 39.

The sensor unit 67 is provided with a shutter 87 configured to be rotated together with the sensor unit 67 to close the second detection hole 43 when the camera 71 and the temperature sensor 73 are not used. The shutter 87 includes a fixer 87*a* fastened to the outer surface of the sensor housing 77 and an opening and closing portion 87*b* extending from the fixer 87*a* to open and close the second detection hole 43.

The fixer 87*a* is fixed to the sensor housing 77 by fastening a fixing screw 93 in a state in which an insulating member 91 such as a mica plate is interposed. The opening and closing portion 87*b* extends from the fixer 87*a* and is bent in a shape corresponding to the inner surface of the sensor receiving portion 39 in which the second detection hole 43 is placed. As illustrated in FIG. 13, the main duct member 99 includes a receiving portion 113 configured to receive a front end of the opening and closing portion 87*b* of the shutter 87 when the sensor unit 67 is in a use position.

As shown in FIG. 12, the driver 69 is installed at one end side of the sensor unit 67. By rotating the sensor unit 67 within a predetermined angle range, the driver 69 may displace the imaging surface 72 of the camera 71, the detection surface 74 of the temperature sensor 73, and the light emitting surface 76 of the light irradiator 75 to the use position (a first position) as illustrated in FIG. 13 or to a non-use position (a second position) as illustrated in FIG. 14.

The use position of the sensor unit 67 is a position in which the imaging surface 72 of the camera 71 faces the first detection hole 41, the detection surface 74 of the temperature sensor 73 faces the second detection hole 43, and the light emitting surface 76 of the light irradiator 75 faces the third detection hole 45. The non-use position of the sensor unit 67 is a position in which the imaging surface 72 of the camera 71 faces a direction different from the first detection hole 41, the detection surface 74 of the temperature sensor 73 faces a direction different from the second detection hole 43, and the light emitting surface 76 of the light irradiator 75 faces a direction different from the third detection hole 45. When the sensor unit 67 is in the non-use position, the second detection hole 43 is closed by the shutter 87.

The partition plate 110 is arranged between the cooling fan 29 and the sensor unit 67, and is arranged on an upstream of a position in which the first detection hole 41 is formed. The partition plate 110 partitions the ventilation path 25 to limit a flow space of the air blown by the cooling fan 29. The air guide member 111 is disposed at a position facing the partition plate 110. The air guide member 111 is installed to be gradually inclined to approach the partition plate 110 as the guide member 111 approaches to a downstream of the ventilation path 25 from an upstream of the ventilation path 25. An upstream side open end between the partition plate 110 and the air guide member 111 faces the cooling fan 29, and a downstream side open end between the partition plate 110 and the air guide member 111 faces the shutter 87. The partition plate 110 and the air guide member 111 may be formed of an insulating material such as a mica plate.

The air, which is blown by the cooling fan 29, flows toward the sensor unit 67 and the shutter 87 while a flow rate of the air increases in the process of passing between the partition plate 110 and the air guide member 111. The sensor unit 67 and the shutter 87 are cooled together by the cooling air. At this time, the cooling air flowing through the ventilation path 25 flows between the imaging surface 72 of the camera 71 and the window member 47 installed in the first detection hole 41, between the detection surface 74 of the temperature sensor 73 and the second detection hole 43, and between the light emitting surface 76 of the light irradiator 75 and the window member 47 installed in the third detection hole 45. Therefore, the camera 71, the temperature sensor 73, the light irradiator 75, and each window member 47 are cooled by the cooling air.

In the heating cooker 1 according to the second embodiment, the shutter 87 opens and closes the second detection hole 43 according to whether the sensor unit 67 is used, and the shutter 87 and the sensor unit 67 are cooled by the cooling air. Accordingly, it is possible to prevent the heat from being transferred from the shutter 87 to the sensor unit 67, which is the same manner as the first embodiment. Therefore, it is possible to prevent the camera 71, the temperature sensor 73, and the light irradiator 75 from being deteriorated or damaged caused by the temperature rise.

When the door 9 is opened, a large amount of the inside air of the cooking chamber 3 flows, and thus oil droplets and water droplets may be moved toward the sensor unit 67 through the second detection hole 43. When the food material is taken out, droplet falling from the food material or a part of the food material may be moved to the sensor unit 67 side through the second detection hole 43 because the sensor receiving portion 39 configured to receive the sensor unit 67 is located below the food material. However, in the heating cooker 1 according to the second embodiment, when the door is opened, the second detection hole 43 may be closed by the shutter 87. Therefore, oil droplets, water droplets and food materials may be prevented from being moved to the sensor unit 67 side. Accordingly, it is possible to secure the reliability of the sensor unit 67.

The heating cooker 1 according to the second embodiment may improve the cooling efficiency of the sensor unit 67 and the shutter 87 because the air guide member 111 sufficiently guides the cooling air of the inside of the ventilation path 25 to the sensor unit 67 and the shutter 87 side. Therefore, it is possible to prevent the camera 71, the temperature sensor 73, and the light irradiator 75 from being deteriorated or damaged caused by the temperature rise.

The heating cooker 1 according to the second embodiment may easily detect the information on the inside of the cooking chamber 3 because the sensor unit 67 is installed in the inside of the door 9 and the imaging surface 72 of the camera 71, the detection surface 74 of the temperature sensor 73 and the light emitting surface 76 of the light irradiator 75 face the inside of the cooking chamber 3 through the first detection hole 41, the second detection hole 43, and the third detection hole 45, respectively. Further, even when foreign material is attached to the window member 47 installed in the first detection hole 41 and the third detection hole 45, it is possible to easily perform maintenance such as wiping the window member 47.

In the heating cooker 1 according to the second embodiment, it is possible to prevent the heat, which moves to the outside of the cooking chamber 3 upon the opening of the door 9, from moving to the inside of the ventilation path 25 through the intake port 31 because the intake port 31 is opened in a direction intersecting an opening and closing direction of the door 9. Therefore, it is possible to secure the cooling function of the sensor unit 67 and the shutter 87 by driving the cooling fan 29.

Meanwhile, the first and second embodiments described above may be variously modified as described below.

The heating cooker is illustrated that a single driver 69 operates the sensor unit 67 and the shutter 87 together in the heating cooker, but is not limited thereto. Alternatively, the sensor unit 67 and the shutter 87 may be provided with a separate driver, respectively.

The sensor unit 67 is illustrated to include the camera 71, the temperature sensor 73, and the light irradiator 75, but is not limited thereto. Alternatively, the sensor unit 67 may include the camera 71 and the temperature sensor 73, or may include the camera 71 and the light irradiator 75. The sensor unit 67 may include other sensors in addition to the camera 71 and the temperature sensor 73. Instead of the sensor unit 67 including the plurality of sensors, a detector including the camera 71, or a detector including the temperature sensor 73, or a detector including other sensor may be installed in the heating cooker.

The heating cooker 1 may include a steam generator, and may include a steam cooking function for supplying steam into the cooking chamber 3. Although the heating cooker 1 is illustrated to have a pyrolytic cleaning function, the heating cooker 1 may have other cleaning functions or exclude the cleaning function.

The detector 17 may include a moving mechanism configured to move the sensor unit 67 in a sliding manner. In this case, according to the sliding movement of the sensor unit 67, the imaging surface 72 of the camera 71, the detection surface 74 of the temperature sensor 73, and the light emitting surface 76 of the light irradiator 75 may be displaced to a use position in which the imaging surface 72, the detection surface 74, and the light emitting surface 76 face the detection hole 41, the second detection hole 43, and the third detection hole 45, respectively, and to a non-use position in which the imaging surface 72, the detection surface 74, and the light emitting surface 76 face a direction different from the detection hole 41, the second detection hole 43, and the third detection hole 45, respectively.

The display 13 and the operator 15 are illustrated as the integral control panel 65, but the display 13 and the operator 15 may be separately installed. Further, the operator 15 may include a button type switch or a dial.

The third heater 57 is illustrated to be installed on the upper and lower sides of the rear wall of the cooking chamber 3, respectively. Alternatively, the third heater 57 may be installed on one of the upper and lower sides of the rear wall of the cooking chamber 3 or installed on the center of the rear wall of the cooking chamber 3.

The mica plate is illustrated as the insulating member 91 interposed in the connection portion between the sensor unit 67 and the shutter 87, but is not limited thereto. Therefore, any insulating member capable of withstanding the heat of the inside of the cooking chamber 3 may be employed.

As is apparent from the above description, the heating cooker may prevent the sensor configured to detect information on the cooking chamber from being deteriorated or damaged caused by a temperature rise.

Although a few embodiments of the disclosure a been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A heating cooker comprising:

a case comprising a cooking chamber configured to receive an object to be heated;

a door configured to open and close the cooking chamber of the case;

a ventilation path provided to extend along a wall surface of the cooking chamber in a state of being partitioned from the cooking chamber;

a detector installed in the inside of the ventilation path and comprising:

one or more sensors configured to detect information on the inside of the cooking chamber through one or more detection holes formed on the wall surface of the cooking chamber, a sensor unit rotatably installed to be spaced apart from an inner surface of the ventilation path, and configured to be coupled the one or more sensors;

a shutter installed in the inside of the ventilation path and configured to open and close the one or more detection holes and wherein the shutter comprises:

a fixer fixed to the sensor unit through an insulating member, and an opening and closing portion provided to extend from the fixer and configured to open and close the one or more detection holes; and a cooling fan configured to suck outside air and blow the outside air into the ventilation path to cool the detector and the shutter together.

2. The heating cooker of claim 1, wherein:

the one or more sensors are spaced apart from an inner surface of the ventilation path, and the shutter is provided in such a way that a part which opens and closes the detection holes is spaced apart from the detector.

3. The heating cooker of claim 1, further comprising an air guide member provided in the ventilation path and configured to guide air blown by the cooling fan to the detector and the shutter.

4. The heating cooker of claim 1, wherein the detector further comprises a driver configured to rotate the sensor unit so as to displace the sensor unit to:

a first position in which a detection surface of the one or more sensors faces the detection holes; and a second position in which the detection surface of the one or more sensors faces a direction different from the detection holes.

5. The heating cooker of claim 4, wherein the sensor unit comprises a sensor housing formed of a material having a lower heat transfer property than the shutter.

6. The heating cooker of claim 4, wherein:

the shutter is mounted on the sensor unit to be rotated together with the sensor unit, when the detection surface of the one or more sensors faces the first position, the shutter opens the detection holes, and when the detection surface of the one or more sensors faces the second position, the shutter closes the detection holes.

7. The heating cooker of claim 1, wherein the opening and closing portion of the shutter is spaced apart from an outer surface of the sensor unit so as to allow cooling air to flow between the outer surface of the sensor unit and an inner surface of the sensor unit.

8. The heating cooker of claim 1, wherein the wall surface of the cooking chamber, on which the detection holes are located, comprises a sensor receiving portion formed to have a cross section in a circular arc shape and provided to protrude toward the inside of the cooking chamber.

9. The heating cooker of claim 8, wherein the opening and closing portion of the shutter is bent in a shape corresponding to an inner surface of the sensor receiving portion.

10. The heating cooker of claim 1, wherein:

the detection holes comprise a first detection hole and a second detection hole that are spaced apart from each other, and the one or more sensors comprises a first sensor provided at a position corresponding to the first detection hole and a second sensor provided at a position corresponding to the second detection hole.

11. The heating cooker of claim 10, wherein:

the first detection hole is covered by a window member having light transmission properties, and the second detection hole is opened when the second sensor is used and the second detection hole is closed by the shutter when the second sensor is not used.

12. The heating cooker of claim 1, wherein:

the case comprises an inner case forming the wall surface of the cooking chamber and an outer case provided on the outside of the inner case, and the ventilation path is arranged between the inner case and the outer case.

13. The heating cooker of claim 12, wherein the ventilation path comprises an upper flow path provided to extend from an intake port formed on an upper front surface of the case to a rear side of the case, the upper flow path limited by a duct coupled to an outer surface of the inner case, the upper flow path configured to receive the detector and the shutter.

14. The heating cooker of claim 13, wherein the ventilation path further comprises a rear flow path formed between the inner case and the outer case at a rear of the case and connected to the upper flow path.

15. The heating cooker of claim 14, wherein the ventilation path further comprises a lower flow path formed between the inner case and the outer case at a lower side of the case, and configured to guide the air of the rear flow path to a discharge port formed on a lower front surface of the case.

16. The heating cooker of claim 1, wherein the door comprises an inner panel configured to form the wall surface of the cooking chamber and an outer panel provided on an outside of the inner panel, and the ventilation path is arranged between the inner panel and the outer panel.

17. The heating cooker of claim 16, wherein the ventilation path is provided to extend in a horizontal direction in an inside of an upper side of the door and comprises an intake port and a discharge port formed at opposite side ends of the door.

18. The heating cooker of claim 17, wherein the intake port and the discharge port are opened in a direction intersecting an opening and closing direction of the door.

* * * * *